US010526865B2

(12) United States Patent
Stæhr

(10) Patent No.: US 10,526,865 B2
(45) Date of Patent: Jan. 7, 2020

(54) ANNULAR BARRIER WITH CLOSING MECHANISM

(71) Applicant: Welltec Oilfield Solutions AG, Zug (CH)

(72) Inventor: Lars Stæhr, Allerød (DK)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 107 days.

(21) Appl. No.: 15/524,828

(22) PCT Filed: Nov. 11, 2015

(86) PCT No.: PCT/EP2015/076321
§ 371 (c)(1),
(2) Date: May 5, 2017

(87) PCT Pub. No.: WO2016/075192
PCT Pub. Date: May 19, 2016

(65) Prior Publication Data

US 2017/0321515 A1 Nov. 9, 2017

(30) Foreign Application Priority Data

Nov. 12, 2014 (EP) ..... 14192870

(51) Int. Cl.
*E21B 33/127* (2006.01)
*E21B 34/06* (2006.01)

(52) U.S. Cl.
CPC ..... *E21B 33/1277* (2013.01); *E21B 34/063* (2013.01)

(58) Field of Classification Search
CPC ..... E21B 33/127; E21B 33/13; E21B 34/063; E21B 43/103
See application file for complete search history.

(56) References Cited

U.S. PATENT DOCUMENTS 3,503,445 A 3/1970 Cochrum et al.
4,527,625 A 7/1985 Wood et al.
(Continued)

FOREIGN PATENT DOCUMENTS

CA 2 093 176 10/1993
CA 2845490 A1 * 7/2013 ..... E21B 23/06
(Continued)

OTHER PUBLICATIONS

International Search Report and Written Opinion of the ISA for PCT/EP2015/076321, dated Jan. 26, 2016, 12 pages.
(Continued)

*Primary Examiner* — Robert E Fuller
*Assistant Examiner* — Lamia Quaim
(74) *Attorney, Agent, or Firm* — Nixon & Vanderhye P.C.

(57) ABSTRACT

The present invention relates to a downhole annular barrier to be expanded in an annulus between a well tubular structure and a wall of a borehole or another well tubular structure downhole in order to provide zone isolation between a first zone having a first pressure and a second zone having a second pressure of the borehole, the annular barrier comprising a tubular part adapted to be mounted as part of the well tubular structure, the tubular part having an outer face and an inside, an expandable metal sleeve surrounding the tubular part and having an inner sleeve face facing the tubular part and an outer sleeve face facing the wall of the borehole, each end of the expandable metal sleeve being connected with the tubular part, and an annular space between the inner sleeve face of the expandable metal sleeve and the tubular part, a first opening in fluid communication with the inside, a second opening in fluid communication with the annular space, a bore having a bore extension and comprising a first bore part having a first inner diameter and a second bore part having an inner diameter
(Continued)

which is larger than that of the first bore part, wherein the first opening and the second opening are arranged in the first bore part and displaced along the bore extension, and the annular barrier further comprises a piston arranged in the bore, the piston comprising a first piston part having an outer diameter substantially corresponding to the inner diameter of the first bore part and comprising a second piston part having an outer diameter substantially corresponding to the inner diameter of the second bore part, and a rupture element preventing movement of the piston until a predetermined pressure in the bore is reached. Furthermore, the present invention relates to an annular barrier system.

20 Claims, 10 Drawing Sheets

(56) References Cited

U.S. PATENT DOCUMENTS

| | | | | |
|---|---|---|---|---|
| 5,400,855 | A | 3/1995 | Stepp et al. | |
| 2002/0092654 | A1* | 7/2002 | Coronado | E21B 33/1208 166/369 |
| 2002/0117309 | A1* | 8/2002 | Guillory | E21B 21/103 166/387 |
| 2006/0042801 | A1* | 3/2006 | Hackworth | E21B 29/10 166/387 |

FOREIGN PATENT DOCUMENTS

| | | |
|---|---|---|
| CN | 201 159 064 | 12/2008 |
| EP | 2 570 588 | 3/2013 |
| RU | 2 128 279 C1 | 3/1999 |
| RU | 34 621 U1 | 12/2003 |
| SU | 1049657 A | 10/1983 |
| SU | 1113514 A | 9/1984 |
| WO | WO 2013/030283 | 3/2013 |

OTHER PUBLICATIONS

Extended Search Report for EP 14192870.5, dated May 4, 2015, 6 pages.

Office Action of Substantive Examination dated Jun. 14, 2019 in Russian Application No. 2017119655/03(034199), with English translation, 14 pages.

* cited by examiner

ANNULAR BARRIER WITH CLOSING MECHANISM

This application is the U.S. national phase of International Application No. PCT/EP2015/076321 filed 11 Nov. 2015, which designated the U.S. and claims priority to EP Patent Application No. 14192870.5 filed 12 Nov. 2014, the entire contents of each of which are hereby incorporated by reference.

FIELD OF THE INVENTION

The present invention relates to a downhole annular barrier to be expanded in an annulus between a well tubular structure and a wall of a borehole or another well tubular structure downhole in order to provide zone isolation between a first zone having a first pressure and a second zone having a second pressure of the borehole. Furthermore, the present invention relates to an annular barrier system.

BACKGROUND ART

Annular barriers are often expanded downhole by means of pressurised fluid entering through an opening in the pipe around which the annular barrier extends, however, operators of oil wells are increasingly demanding that this opening is permanently closed.

One solution to this problem has been to insert check valves in the opening, however, this solution has shown to fail as dirt may get stuck in the ball seat, thereby preventing the ball from closing the opening properly. Further, as temperature and pressure increase and decrease, e.g. during a fracturing process, the temperature and pressure of the entrapped fluid in the annular barrier increase and decrease accordingly. During increased pressure, the annular barrier is expanded more than intended, and during decreasing pressure, the annular barrier deflates accordingly, and such movements may rupture the annular barrier over time.

SUMMARY OF THE INVENTION

It is an object of the present invention to wholly or partly overcome the above disadvantages and drawbacks of the prior art. More specifically, it is an object to provide an improved annular barrier having a simple closure of the opening in the base pipe after expansion of the annular barrier.

The above objects, together with numerous other objects, advantages and features, which will become evident from the below description, are accomplished by a solution in accordance with the present invention by a downhole annular barrier to be expanded in an annulus between a well tubular structure and a wall of a borehole or another well tubular structure downhole in order to provide zone isolation between a first zone having a first pressure and a second zone having a second pressure of the borehole, the annular barrier comprising:

- a tubular part adapted to be mounted as part of the well tubular structure, the tubular part having an outer face and an inside,
- an expandable metal sleeve surrounding the tubular part and having an inner sleeve face facing the tubular part and an outer sleeve face facing the wall of the borehole, each end of the expandable metal sleeve being connected with the tubular part, and
- an annular space between the inner sleeve face of the expandable metal sleeve and the tubular part,

- a first opening in fluid communication with the inside,
- a second opening in fluid communication with the annular space, and
- a bore having a bore extension and comprising a first bore part having a first inner diameter and a second bore part having an inner diameter which is larger than that of the first bore part, wherein the first opening and the second opening are arranged in the first bore part and displaced along the bore extension, and the annular barrier further comprises:

- a piston arranged in the bore, the piston comprising a first piston part having an outer diameter substantially corresponding to the inner diameter of the first bore part and comprising a second piston part having an outer diameter substantially corresponding to the inner diameter of the second bore part, and
- a rupture element preventing movement of the piston until a predetermined pressure in the bore is reached.

The piston has a round cross-section which is arranged in a round bore, and neither the piston nor the bore are annular, which increases the fitting so that the clearance between the piston and the bore can be made very small, and unwanted leakage can thereby be avoided.

Furthermore, the piston may have a centre axis arranged in a wall of the tubular part or in a wall of a connection part connecting the expandable metal sleeve with the tubular part.

In an embodiment, the downhole annular barrier may further comprise a locking element adapted to mechanically lock the piston when the piston is in the closed position, blocking the first opening.

Furthermore, the locking element may be configured to move at least partly radially outwards or inwards upon movement of the piston away from the initial position to prevent the piston from returning to an initial position of the piston.

Moreover, the locking element may permanently lock the piston in the closed position.

Furthermore, the locking element may be configured to move radially inwards upon movement of the piston away from the initial position.

Also, the locking element may be configured to move radially inwards and abut the second piston face of the piston upon movement of the piston away from the initial position.

Moreover, the locking element may be configured to move partly radially outwards upon movement of the piston away from the initial position.

In addition, the locking element may prohibit the piston from returning to its initial position.

Also, the locking element may surround a part of the piston.

Moreover, the locking element may be forced towards the piston by a spring member.

In an embodiment, the annular barrier may comprise a third opening which is in fluid communication with the annulus.

Furthermore, the piston may have an initial position in which the first opening is in fluid communication with the second opening, and a closed position in which the second opening is in fluid communication with the third opening in order to equalise the pressure between the annular space and the annulus.

In the closed position in which the second opening is in fluid communication with the third opening, the pressure between the annular space and the annulus may be equalised.

The piston may comprise a fluid channel being a through bore providing fluid communication between the first and second bore parts.

By having a piston comprising a fluid channel being a through bore providing fluid communication between the first and second bore parts, the fluid pressure acts on the second piston face facing away from the first opening, and thus, a very simple construction is provided with a minimum of flow paths having a risk of becoming clogged.

Furthermore, by having a piston with a fluid channel, fluid communication between the first and second bore parts is provided so that the piston can move upon rupture of the rupture element, resulting in fluid communication to the inside of the tubular part being closed off. In this way, a simple solution without further fluid channels is provided, and due to the fact that the second piston part has an outer diameter which is larger than that of the first piston part, the surface area onto which fluid pressure is applied is larger than that of the first piston part. Thus, the pressure moves the piston when the annular barrier is expanded, and pressure is built up for breaking the rupture element, which allows the piston to move.

Moreover, the rupture element may be a shear pin engaging the piston.

Also, the rupture element may be a shear disc arranged in the fluid channel or the first bore part for preventing flow past the disc.

Further, the disc may block the fluid channel or the first bore part.

The bore may have a second bore end in the second bore part and a first bore end in the first bore part, the disc being arranged between the first opening and the second bore part.

In addition, the piston may have a first piston end at the first piston part and a second piston end at the second piston part, the first piston end having a first piston face and the second piston end having a second piston face, the second piston face having a face area which is larger than a face area of the first piston face in order to move the piston towards the first bore end.

Movement of the piston may close fluid communication between the first opening and the second opening.

Furthermore, the first piston part may extend partly into the second bore part in an initial position of the piston and form an annular space between the piston and an inner wall of the bore.

The downhole annular barrier according to the present invention may further comprise a third opening in the second bore part, which third opening may be in fluid communication with the annular space and the annulus.

Moreover, a shuttle valve may be arranged between the third opening and the annulus, thus providing fluid communication between the annular space and the annulus.

Said shuttle valve may, in a first position, provide fluid communication between the annular space and the first zone of the annulus and may, in a second position, provide fluid communication between the annular space and the second zone of the annulus.

Also, the first piston part may comprise two annular sealing elements arranged in an annular groove in the first piston part.

The annular sealing elements may be arranged at a predetermined distance, meaning that the sealing elements are arranged at opposite sides of the first opening in a closed position of the piston.

Furthermore, the second piston face may be arranged at a distance from the second bore end in the initial position.

Additionally, the second piston part may comprise at least one sealing element arranged in an annular groove.

Moreover, the downhole annular barrier according to the present invention may further comprise a locking element adapted to mechanically lock the piston when the piston is in the closed position, blocking the first opening.

In this way, a permanent closure of fluid communication between the annular space and the inside of the well tubular structure is obtained. In the known solutions, one-way valves, such as ball valves, are used for the same purpose in order to let fluid into the space of the annular barrier but prevent it from escaping again. By using such check valves, the fluid inside the annular barrier is entrapped, and during e.g. fracturing of the formation where typically colder fluid is used for fracking the formation, fluid is let into the annular barrier at e.g. 300 bar which is the maximum pressure at which the annular barrier is tested to withstand without fracturing the expandable metal sleeve. When the fracking is effected using the cold fluid having a pressure of 300 bar, the annular barrier is equally filled with the cold fluid at the pressure of 300 bar. Subsequently, when the fracking has ended, the annular barrier is heated, causing the pressure in the annular barrier to increase above the maximum pressure, since the fluid inside the annular barrier cannot escape from the annular space due to the check valve, and the expandable metal sleeve is therefore at high risk of breaking or rupturing. Thus, each time the temperature changes downhole, the pressure inside the annular barrier changes as well, and the sleeve is consequently expanded or crimped accordingly, which can result in breakage or rupture of the expandable metal sleeve. By permanently blocking the fluid communication between the annular space and the inside of the well tubular structure, the expandable metal sleeve will not undergo such large changes, which substantially reduces the risk of rupturing.

Also, the second piston part may comprise the locking element arranged in the second piston end of the piston, and the locking element being springy elements projecting outwards when being released when the piston moves to block the first opening.

The locking element may be collets forming in the second piston end of the piston.

When using a mechanical lock preventing backwards movement of the piston, there is no need for a check valve to prevent the return of the piston when the pressure inside the annular barrier increases. In this way, the risk of dirt preventing closure of the check valve and the risk that a pressure increase in the annular space of the barrier forces the piston to return and provide fluid communication from the inside of the tubular part again are eliminated. In the known solutions using check valves, the expandable metal sleeve has a potential risk of breaking or rupturing when the formation is fracked with colder fluid, such as seawater. By permanently blocking the fluid communication between the annular space and the inside of the well tubular structure, the expandable metal sleeve will not undergo such large changes in temperature and pressure, which substantially reduces the risk of rupturing.

Further, the locking element may be arranged around the second piston part.

Moreover, the bore may have a third bore part, the second bore part being arranged between the first bore part and the third bore part, the third bore part having an inner diameter which is larger than the inner diameter of the second bore part, and the locking element being arranged in third bore part.

Furthermore, the locking element may be a plurality of inserts arranged in the third bore part around the second piston end.

The locking element may further comprise at least one spring member arranged in a circumferential groove of an outer face of the inserts, so that the inserts are held together and forced radially inwards when the piston moves to close off for fluid communication to the inside of the tubular part.

The present invention also relates to a downhole annular barrier system comprising a downhole annular barrier as described above and a pressure source.

Said pressure source may be arranged at the surface or seabed or at the well head or blowout preventer.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
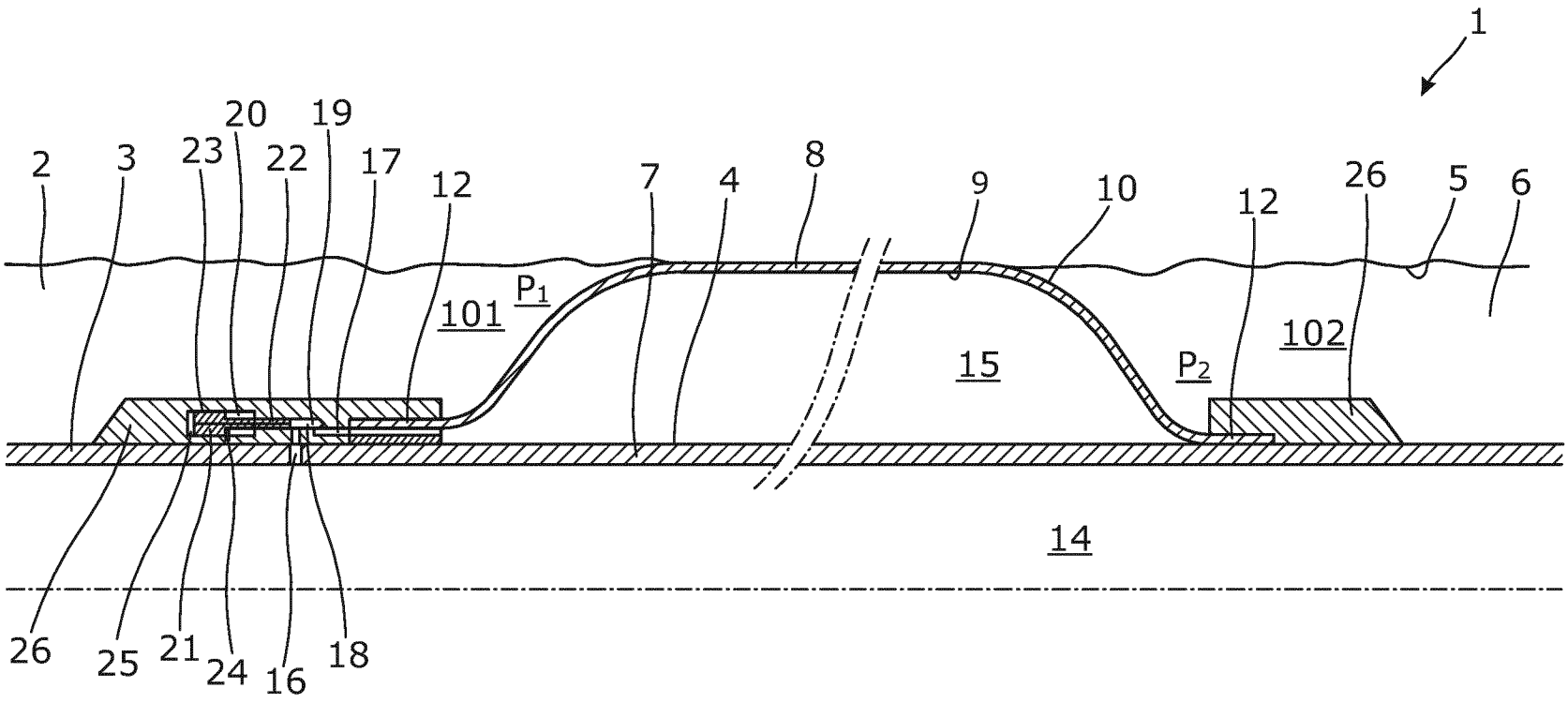
FIG. 1 shows a cross-sectional view of an annular barrier.

FIG. 1 shows a downhole annular barrier 1 to be expanded in an annulus 2 between a well tubular structure 3 and a wall 5 of a borehole 6 downhole in order to provide zone isolation between a first zone 101 having a first pressure $P_1$ and a second zone 102 having a second pressure $P_2$ of the borehole. The annular barrier comprises a tubular part 7 adapted to be mounted as part of the well tubular structure 3 and having an inside being the inside of the well tubular structure and thus in fluid communication therewith. The annular barrier 1 further comprises an expandable metal sleeve 8 surrounding the tubular part 7 and having an inner sleeve face 9 facing the tubular part and an outer sleeve face 10 facing the wall 5 of the borehole 6, and the outer sleeve face abuts the wall in the expanded position shown in FIG. 1. Each end 12 of the expandable metal sleeve 8 is connected with the tubular part 7, creating an annular space 15 between the inner sleeve face 9 of the expandable metal sleeve and the tubular part. The annular barrier 1 has a first opening 16 in fluid communication with the inside of the well tubular structure and thus the tubular part, and a second opening 17 of the annular barrier is in fluid communication with the annular space 15. When the inside of the tubular part 7 is pressurised, fluid flows into the annular space 15, thereby expanding the expandable metal sleeve 8 to the expanded position, as shown in FIG. 1.

The annular barrier 1 further comprises a bore 18 having a bore extension and comprising a first bore part 19 having a first inner diameter ($ID_1$ in FIG. 2A) and a second bore part 20 having an inner diameter ($ID_2$ in FIG. 2A) which is larger than that of the first bore part. The first opening and the second opening are arranged in the first bore part 19 and are displaced along the bore extension. The annular barrier 1 further comprises a piston 21 arranged in the bore 18, the piston comprising a first piston part 22 having an outer diameter ($OD_{P1}$ in FIG. 2B) substantially corresponding to the inner diameter of the first bore part 19, and comprising a second piston part 23 having an outer diameter ($OD_{P2}$ in FIG. 2B) substantially corresponding to the inner diameter of the second bore part 20. The annular barrier 1 further comprises a rupture element 24 preventing movement of the piston 21 until a predetermined pressure in the bore 18 is reached. The strength of the rupture element is set based on a predetermined pressure acting on the areas of the ends of the piston, and thus, the difference in outer diameters results in a movement of the piston when the pressure exceeds the predetermined pressure. The piston 21 comprises a fluid channel 25 being a through bore providing fluid communication between the first and second bore parts 19, 20.

By having a piston with a fluid channel, fluid communication between the first and second bore parts is provided so that upon rupture of the rupture element, the piston can move, resulting in fluid communication to the inside of the tubular part being closed off. In this way, a simple solution without further fluid channels is provided, and due to the fact that the second piston part has an outer diameter which is larger than that of the first piston part, the surface area onto which fluid pressure is applied is larger than that of the first piston part. Thus, the pressure moves the piston when the annular barrier is expanded and pressure has been built up for breaking the rupture element 24, which allows the piston to move. The annular space 15 (shown in FIG. 6) is fluidly connected with the borehole via a hole 61, shown in FIG. 2A, and the pressure in the annular space can thus be relieved.

Figure 2A:
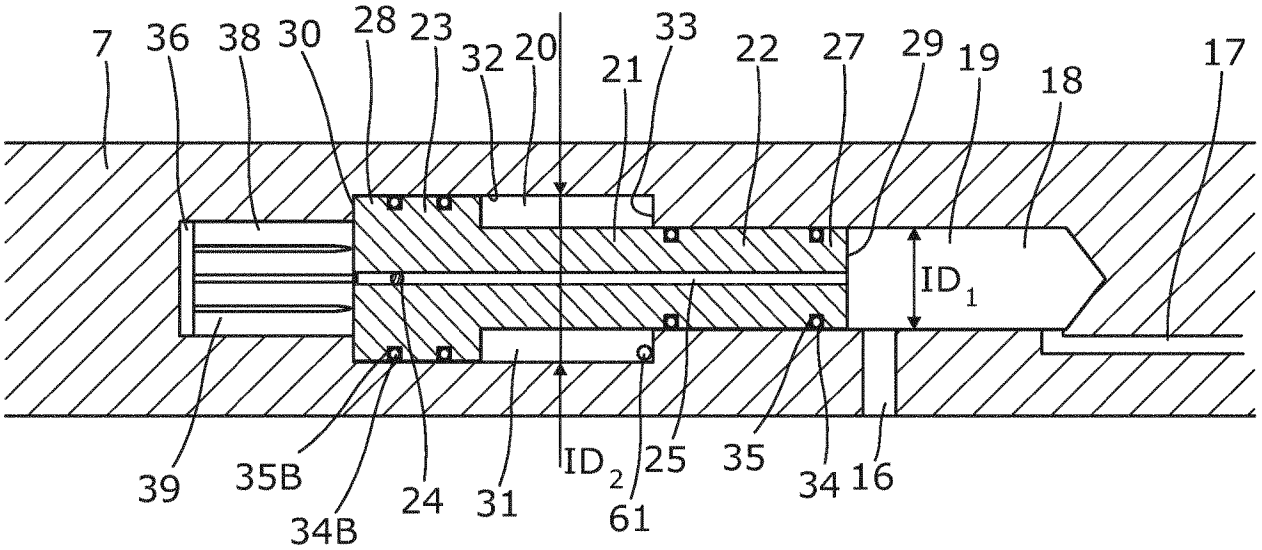
FIG. 2A shows a cross-sectional view of part of the annular barrier of FIG. 1 having a bore with a piston in an initial position.
Figure 2B:
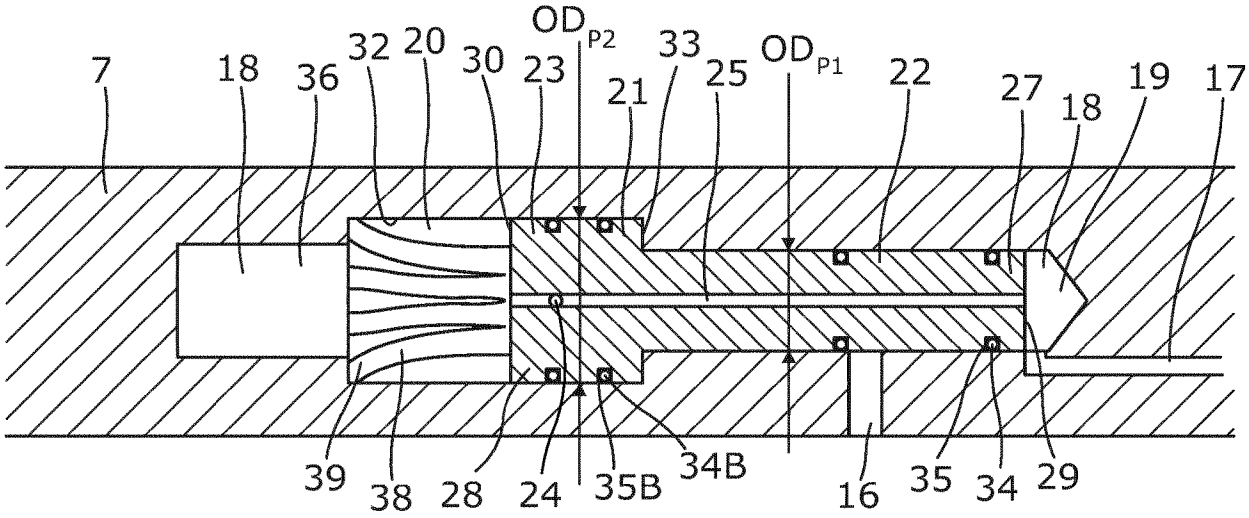
FIG. 2B shows the piston of FIG. 2A in its closed position.
Figure 11A:
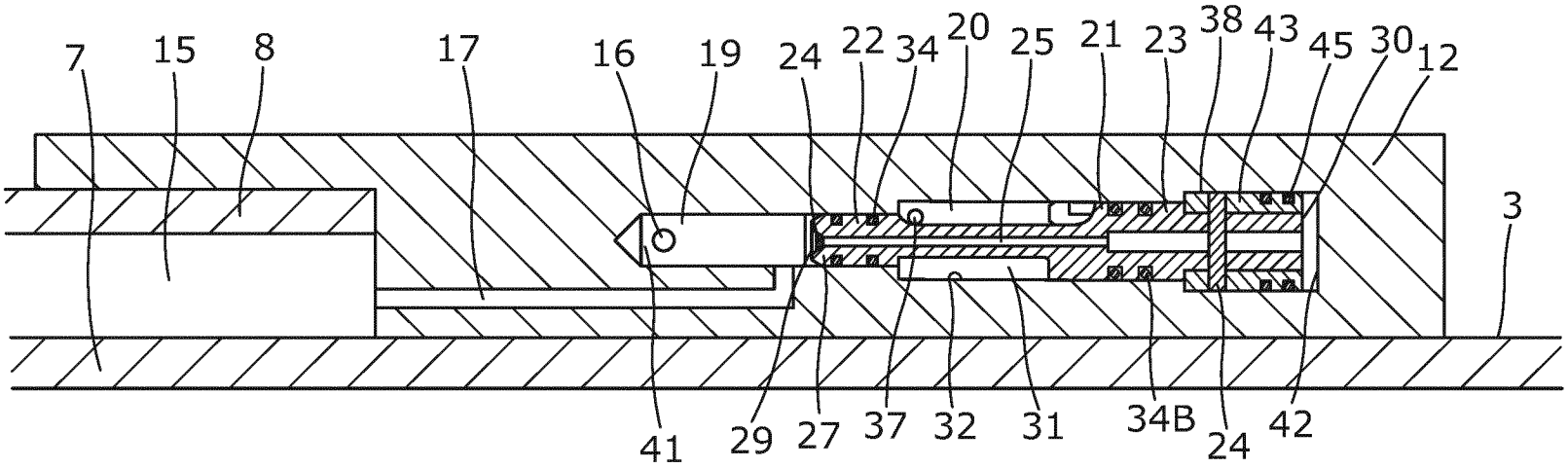
FIG. 11A shows another embodiment of the piston in its initial position.
Figure 11B:
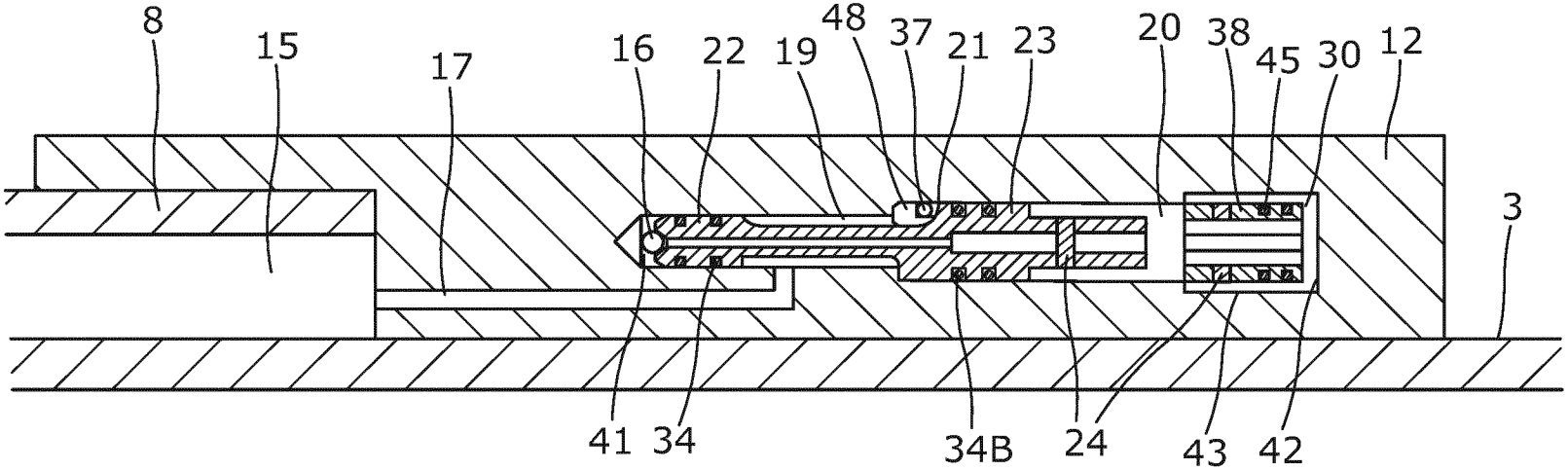
FIG. 11B shows the piston of FIG. 11A in its closed position.

In FIG. 1, the rupture element 24 is a shear disc, and in FIGS. 2A, 2B, 11A and 11B the rupture element is a shear pin. In FIG. 11A, the shear pin is intact and extends through the piston and the inserts 43, and in FIG. 11B, the shear pin is sheared and the piston is allowed to move, and the inserts 43 have moved towards the centre of the bore 18. Depending on the isolation solution required to provide isolation downhole, the rupture element 24 is selected based on the expansion pressure so as to break at a pressure higher than the expansion pressure but lower than the pressure rupturing the expandable metal sleeve or jeopardising the function of other completion components downhole. In FIG. 1, the bore 18 and the piston 21 are arranged in a connection part 26 connecting the expandable metal sleeve 8 with the tubular part 7. In FIGS. 2A and 2B, the bore 18 and piston 21 are arranged in the tubular part 7.

In FIGS. 2A and 2B, the piston 21 has a first piston end 27 at the first piston part 22 and a second piston end 28 at the second piston part 23, and the first piston end has a first piston face 29 and the second piston end has a second piston face 30. Furthermore, the second piston face 30 has a face area which is larger than a face area of the first piston face 29 in order to move the piston 21 towards the first bore part 19. The difference in face area creates a difference in the force acting on the piston 21, causing the piston to move to close off the fluid communication between the first opening 16 and the second opening 17.

As shown in FIG. 2A, the first piston part 22 extends partly into the second bore part 20 in an initial position of the piston 21 and forms an annular space 31 between the piston and an inner wall 32 of the bore. The movement of the piston 21 when the fluid presses onto the second piston face 30 stops when the second piston part 23 reaches the first bore part 19, causing the second piston part to rest against an annular face 33 created by the difference between the inner diameters of the first and the second bore parts 19, 20, which is shown in FIG. 2B. The annular space 31 is fluidly connected with the annulus between the well tubular structure and the inner wall of the borehole and is thus pressure-relieved via a hole 61, thereby allowing the movement of the piston 21.

The first piston part 22 comprises two annular sealing elements 34, each arranged in an annular groove 35 in the first piston part 22. The annular sealing elements 34 are arranged at a predetermined distance and are thereby arranged at opposite sides of the first opening 16 in a closed position of the piston 21, as shown in FIG. 2B. Furthermore, the second piston part 23 comprises two sealing elements 34B arranged in an annular groove 35B.

In FIGS. 2A and 2B, the annular barrier further comprises a locking element 38 adapted to mechanically lock the piston 21 when the piston is in the closed position, blocking the first opening 16, as shown in FIG. 2B.

In the known solutions, one-way valves, such as ball valves, are used for the same purpose, i.e. letting fluid into the space of the annular barrier but preventing it from escaping again. By using such check valves, the fluid inside the annular barrier is entrapped, and during e.g. fracturing of the formation where typically colder fluid is used for fracking the formation, fluid is let into the annular barrier at e.g. 300 bar which is the maximum pressure at which the annular barrier is tested to withstand without fracturing the expandable metal sleeve. When the fracking is affected using the cold fluid having a pressure of 300 bar, the annular barrier is equally filled with the cold fluid at the pressure of 300 bar. Subsequently, when the fracking has ended, the annular barrier is heated, causing the pressure in the annular barrier to increase to above the maximum pressure since the fluid inside the annular barrier cannot escape from the annular space due to the check valve, and the expandable metal sleeve is therefore at high risk of breaking or rupturing. Thus, each time the temperature changes downhole, the pressure inside the annular barrier changes as well, and the sleeve is consequently expanded or crimped accordingly, which can result in breakage or rupture of the expandable metal sleeve. By permanently blocking the fluid communication between the annular space and the inside of the well tubular structure, the expandable metal sleeve will not undergo such large changes, which substantially reduces the risk of rupturing.

In FIG. 2A, the second piston part 23 comprises the locking element 38 arranged in the second piston end 28 of the piston 21. The locking element 38 may be springy elements 39 projecting outwards but being suppressed in a third bore part 36 when the piston 21 is in the initial position, and the springy elements are released when the piston moves to block the first opening 16, and the springy elements thus project radially outwards, as shown in FIG. 2B. Thus, the locking element 38 is collets forming in the second piston end 28 of the piston 21. The second bore part 20 is arranged between the first bore part 19 and the third bore part 36, and the third bore part has an inner diameter which is larger than the inner diameter of the second bore part.

When using a mechanical lock preventing backwards movement of the piston, there is no need for a check valve to prevent the return of the piston when the pressure inside the annular barrier increases. In this way, the risk of dirt preventing closure of the check valve and the risk that a pressure increase in the annular space of the barrier forces the piston to return and provide fluid communication from the inside of the tubular part again are eliminated. In the known solutions using check valves, the expandable metal sleeve has a potential risk of breaking or rupturing when the formation is fracked with colder fluid, such as seawater. By permanently blocking the fluid communication between the annular space and the inside of the well tubular structure, the expandable metal sleeve will not undergo such large changes in temperature and pressure, which substantially reduces the risk of rupturing.

Figure 3A:
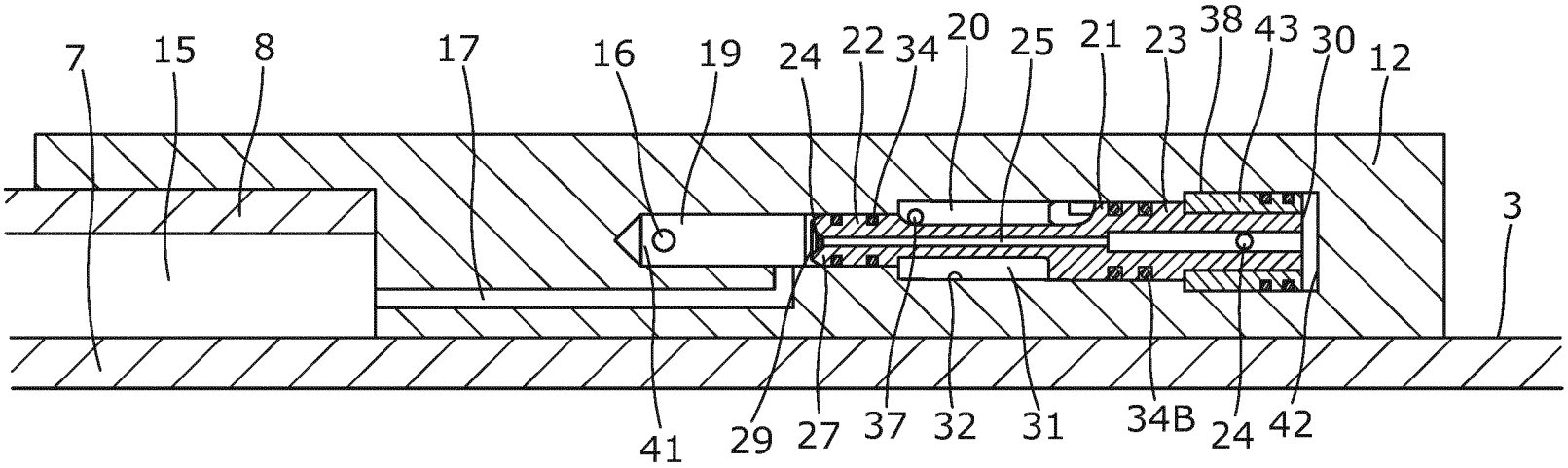
FIG. 3A shows another embodiment of the piston in its initial position.
Figure 7:
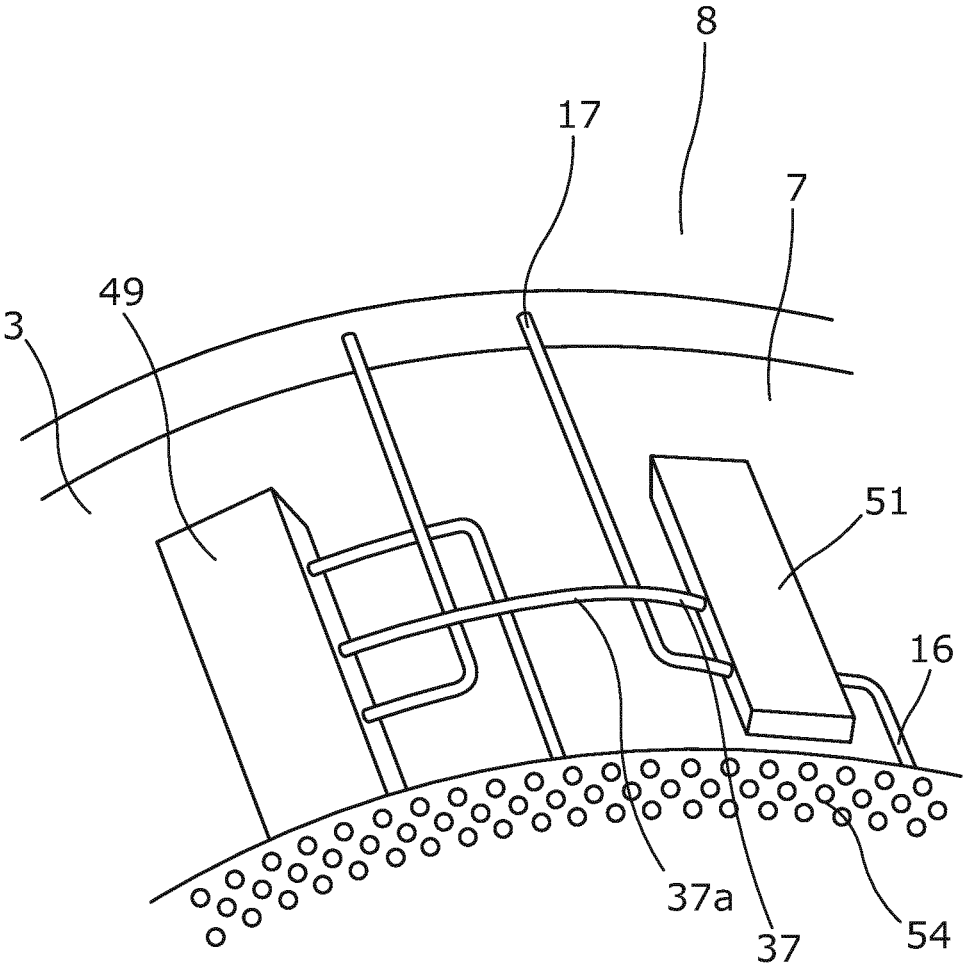
FIG. 7 shows a perspective view of a shuttle valve.

In FIG. 3A, the annular barrier 1 comprises a locking element 38 which is arranged around the second piston part 23. The bore further comprises a third opening 37 in the second bore part 20, which third opening is in fluid communication with the annular space 15 and the annulus 2. The third opening 37 may be arranged in fluid communication with a shuttle valve 49, as shown in FIG. 7, in such a way that the shuttle valve is arranged between the third opening and the annulus, thus providing fluid communication between the annular space and the annulus. The shuttle valve 49 provides, in a first position, fluid communication between the annular space and the first zone 101 of the annulus (shown in FIG. 1), and in a second position, the shuttle valve provides fluid communication between the annular space and the second zone 102 of the annulus (shown in FIG. 1).

In FIG. 7, an assembly 51 having the bore with the piston has the first opening 16 receiving fluid from the inside of the well tubular structure 3 through the screen 54. The first opening 16 is fluidly connected with the second opening 17 during expansion, causing the expansion fluid in the well tubular structure 3 to expand the expandable metal sleeve 8. When the expandable metal sleeve 8 is expanded to abut the wall of the borehole, the pressure builds up and the rupture element within the assembly shears to close off the fluid connection from the first opening 16 and opens the fluid connection 37*a* via the third opening 37 to the shuttle valve 49. When the first pressure $P_1$ increases in the first zone 101 (see FIG. 1), fluid from the first zone is connected with the shuttle valve and let into the annular space. When the second pressure $P_2$ increases in the second zone 102 (see FIG. 1), the shuttle valve shifts, and fluid is let from the second zone into the annular space.

Figure 3B:
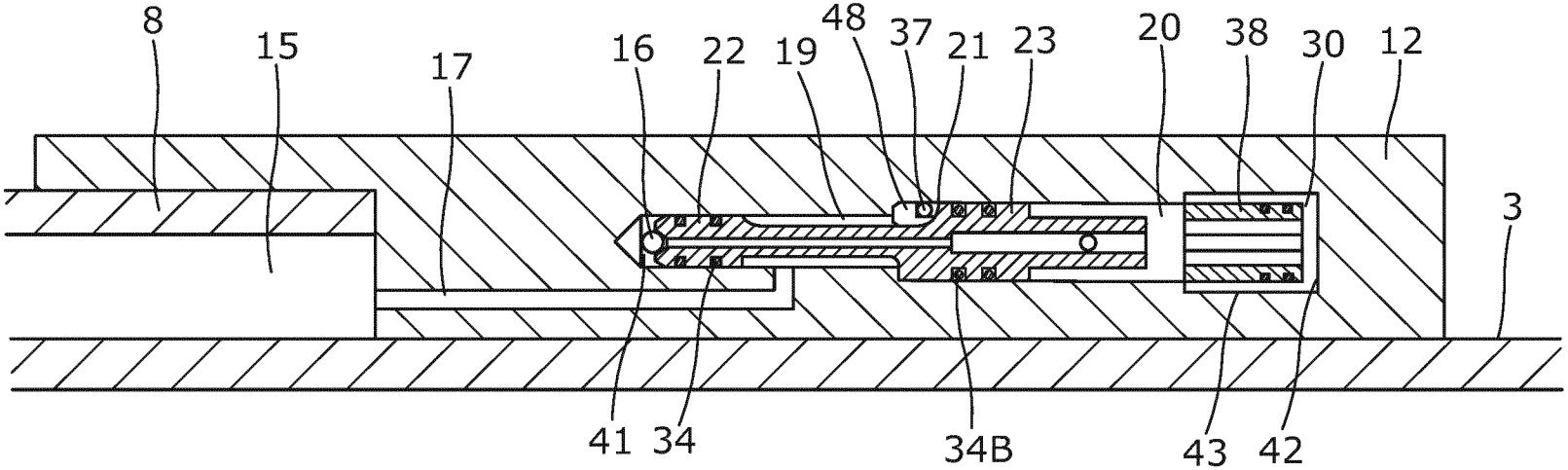
FIG. 3B shows the piston of FIG. 3A in its closed position.
Figure 5:
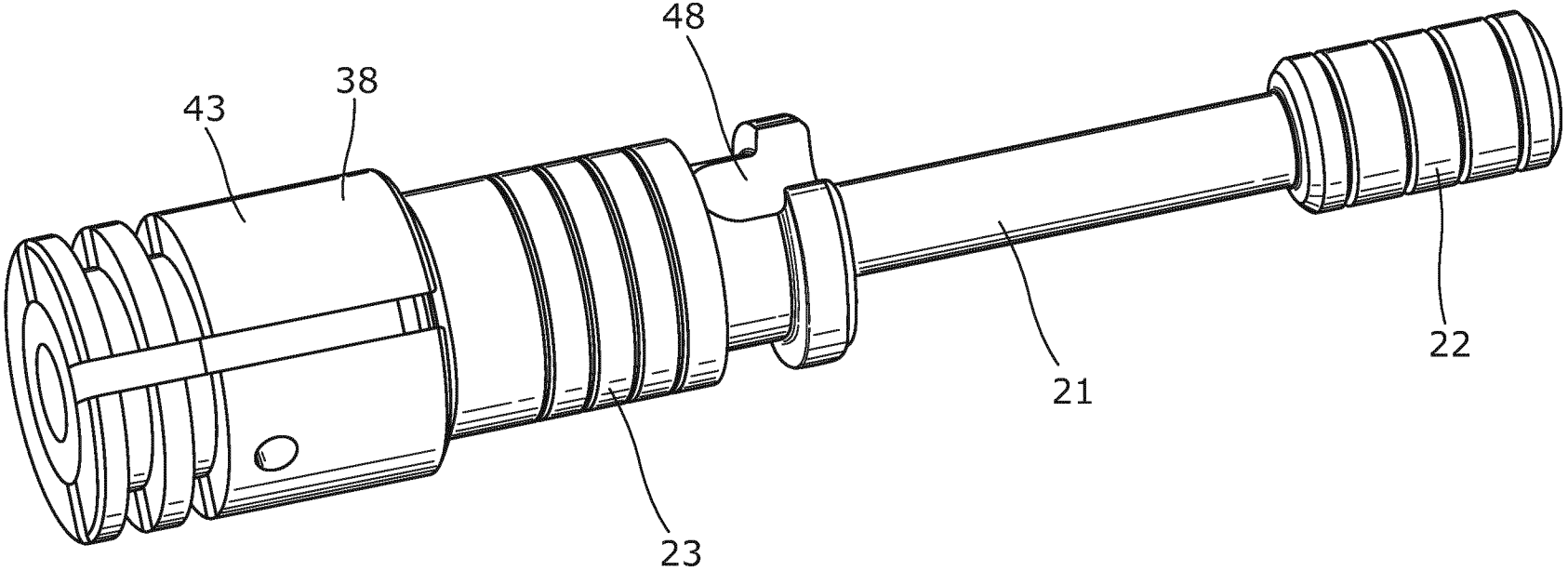
FIG. 5 shows a perspective view of the piston of FIG. 3A.

When the piston 21 moves to the closed position, shown in FIG. 3B, a recess 48 in the second piston part 23 provides fluid communication between the second opening and the third opening, so that fluid communication between the annular space 15 and the third opening is provided in the closed position of the piston 21. The recess 48 in the piston 21 is further disclosed in FIG. 5.

In FIG. 3A, the rupture element 24 is a shear disc arranged in the fluid channel, but in another embodiment, a shear disc may be arranged in the first bore part 19 for preventing flow past the disc. The disc thus blocks the fluid channel or the first bore part 19. In FIG. 3A, the bore has a second bore end 42 in the second bore part 20 and a first bore end 41 in the first bore part 19, and the second piston face 30 is arranged at a distance from the second bore end 42 in the initial position. In the closed position shown in FIG. 3B, the distance between the second piston face 30 and the second bore end 42 is increased.

Figure 4:
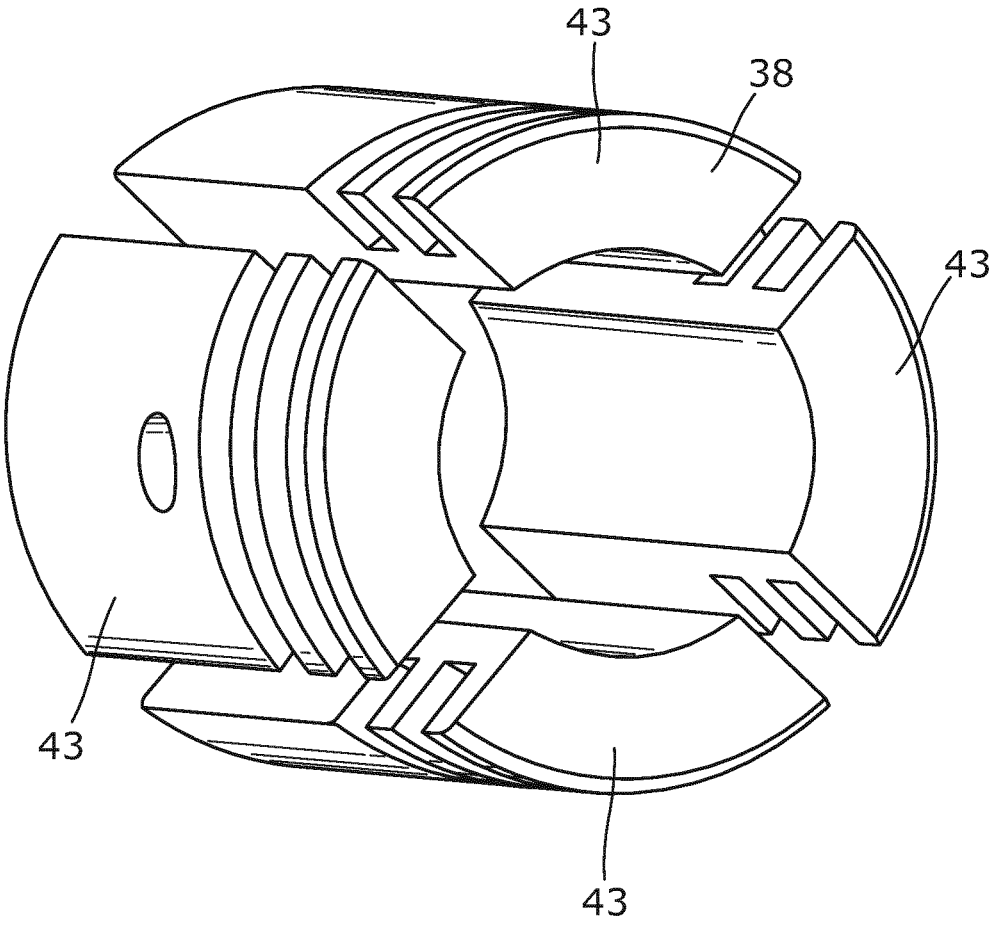
FIG. 4 shows a perspective view of a locking element.

In FIGS. 3A and 3B, the locking element 38 is a plurality of inserts 43 arranged in the third bore part around the second piston end. The inserts 43 are held together by rings 45, such as O-rings, circlips, split rings or key rings. As the piston 21 moves from the initial position shown in FIG. 3A to the closed position shown in FIG. 3B, the inserts 43 fall inwards and block the return of the piston and secure permanent closure of the fluid communication between the first opening 16 and the annular space 15 of the annular barrier. The inserts 43 are shown in perspective in FIG. 4.

Figure 8:
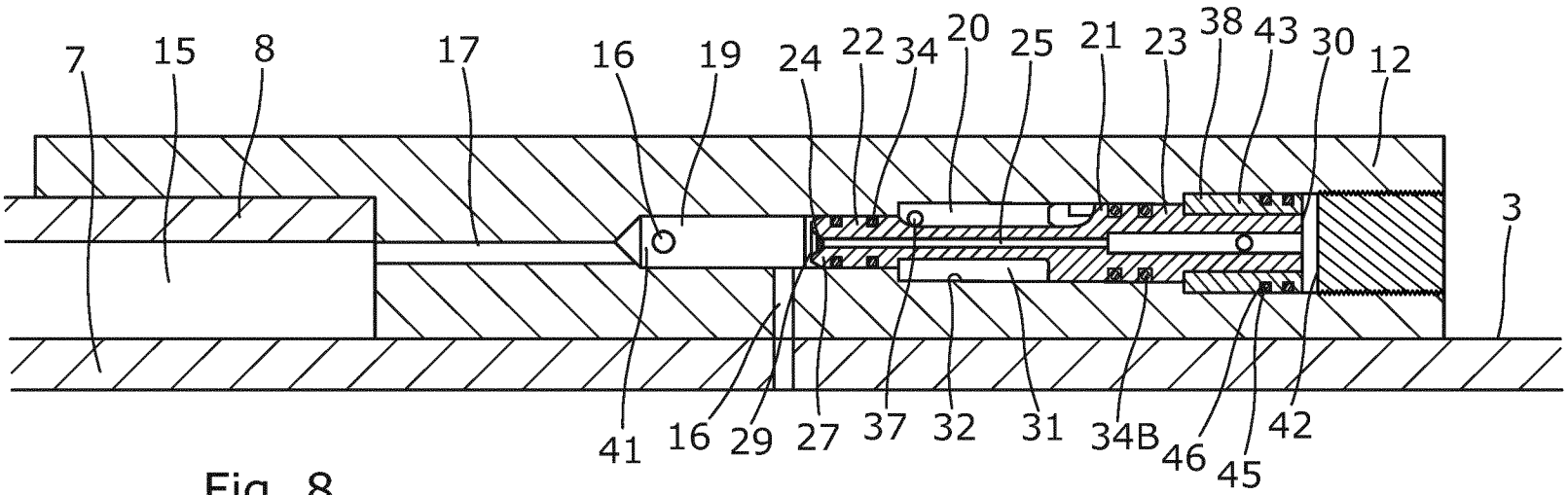
FIG. 8 shows another embodiment of the piston in its initial position.

In FIG. 8, the locking element 38 further comprises at least one spring member 45 arranged in a circumferential groove 46 of an outer face of the inserts 43, so that the inserts are held together and forced radially inwards when the piston 21 moves to close off for fluid communication to the inside of the tubular part 7.

Figure 9:
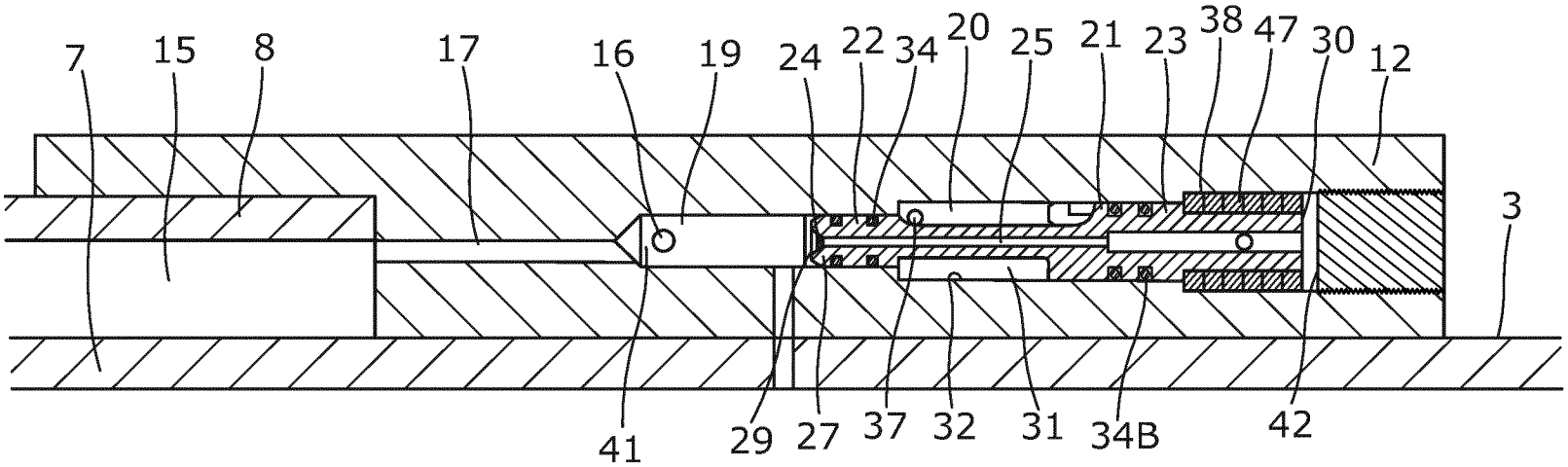
FIG. 9 shows yet another embodiment of the piston in its initial position.

In FIG. 9, the locking element 38 is a spring member 47, such as a coiled spring, a key ring or snap rings, being expanded in the initial position, and the spring force is released when the piston 21 moves, so that the spring member retracts to a smaller outer diameter.

Figure 6:
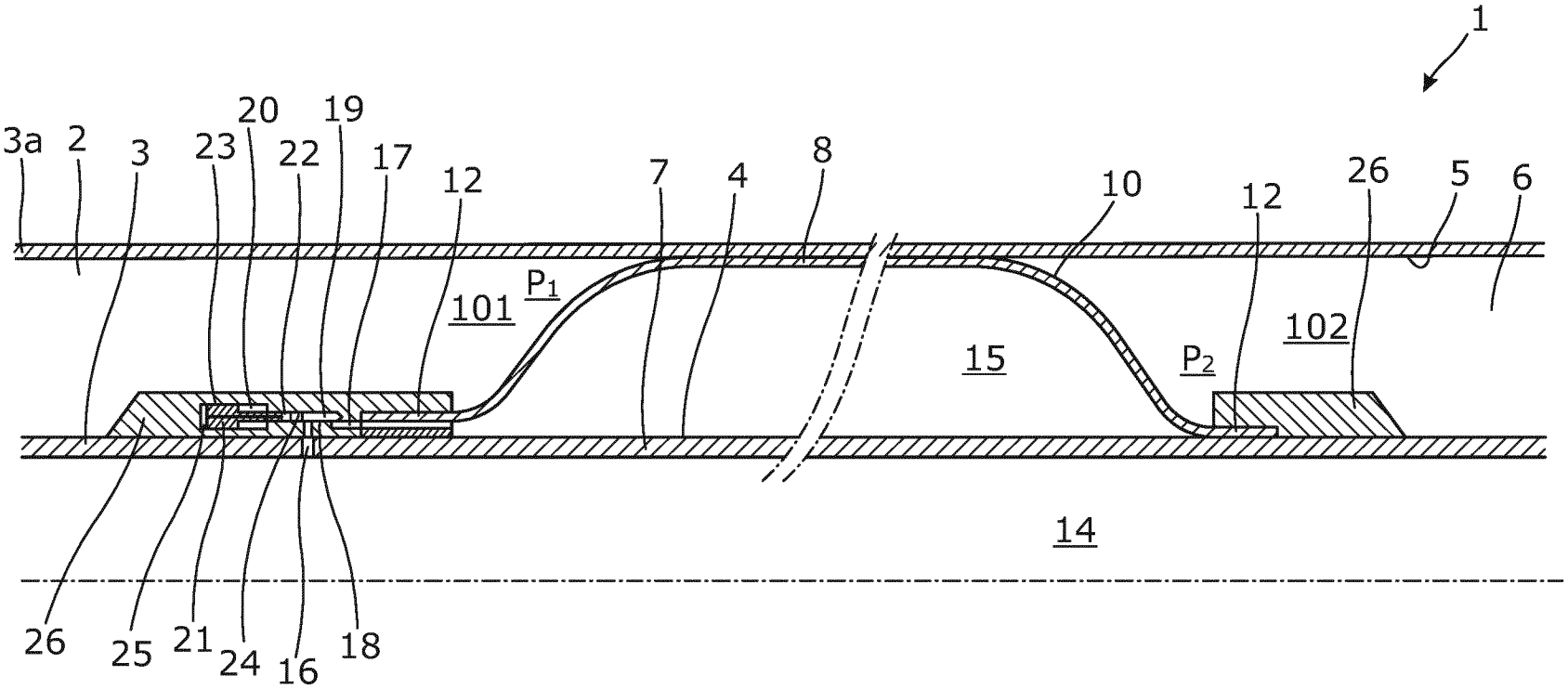
FIG. 6 shows a cross-sectional view of the annular barrier abutting a second well tubular structure.

In FIG. 6, the annular barrier 1 is expanded to abut a second well tubular structure 3*a*, and the disc 24 is arranged between the first opening 16 and the second bore part 20.

Figure 10:
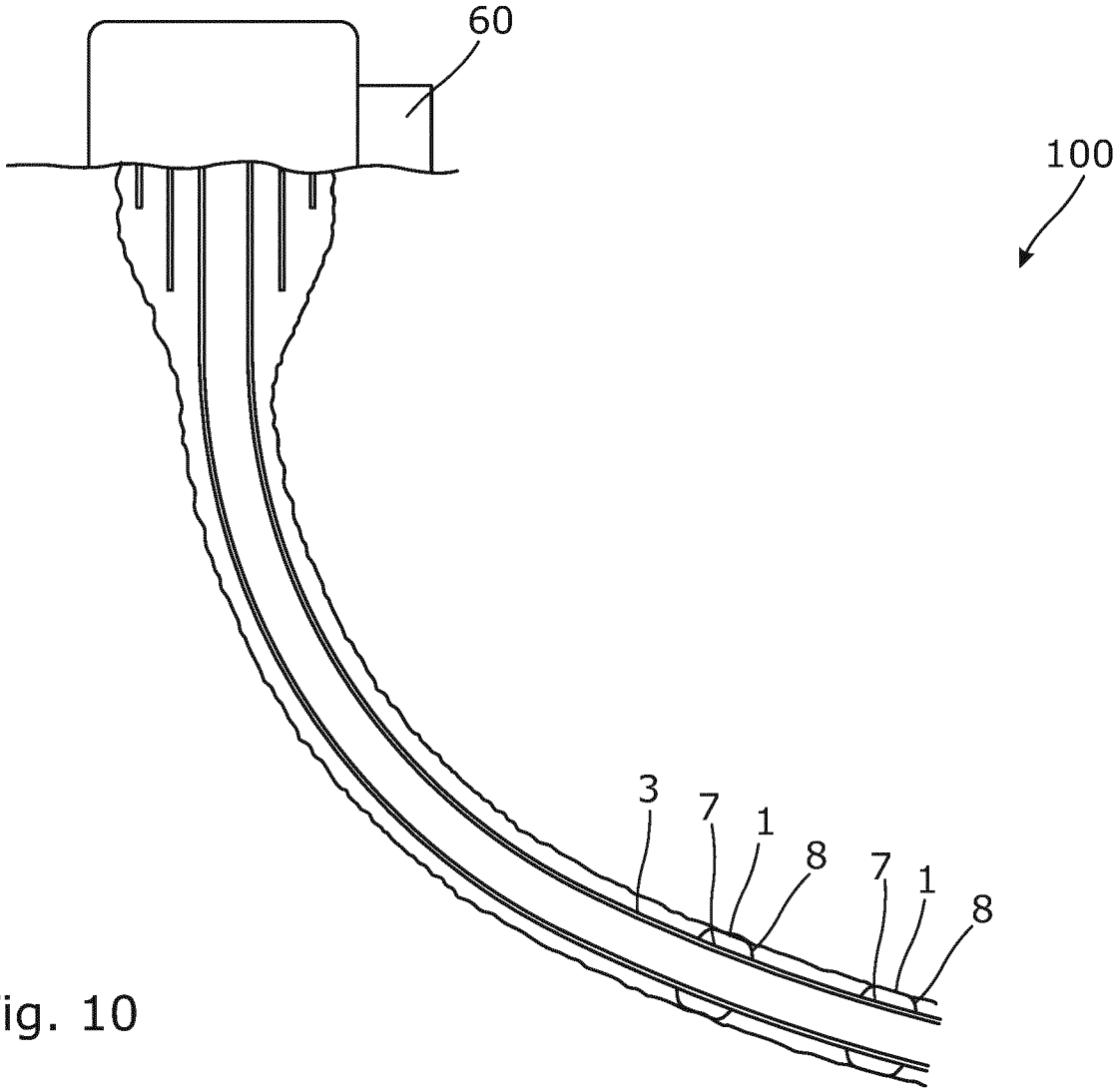
FIG. 10 shows a partly cross-sectional view of an annular barrier system.

FIG. 10 shows a downhole annular barrier system 100 comprising two downhole annular barriers 1 and a pressure source 60 arranged at the surface/seabed or at the well head or blowout preventer.

The expandable metal sleeve is made of a flexible material, such as elastomer, rubber or metal, so that the sleeve can be expanded and provide zone isolation. The tubular part is made of metal.

The annular barrier is thus a metal annular barrier having both an expandable sleeve made of metal and a tubular part made of metal. The annular barrier may further comprise annular sealing elements arranged in such a way that they abut and surround the expandable metal sleeve.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A downhole annular barrier to be expanded in an annulus between a well tubular structure and a wall of a borehole or another well tubular structure downhole in order to provide zone isolation between a first zone having a first pressure and a second zone having a second pressure of the borehole, the annular barrier comprising:

a tubular part adapted to be mounted as part of the well tubular structure, the tubular part having an outer face and an inside, an expandable metal sleeve surrounding the tubular part and having an inner sleeve face facing the tubular part and an outer sleeve face facing the wall of the borehole, each end of the expandable metal sleeve being connected with the tubular part, and an annular space between the inner sleeve face of the expandable metal sleeve and the tubular part, a first opening in fluid communication with the inside, a second opening in fluid communication with the annular space, and a bore having a bore extension and comprising a first bore part having a first inner diameter and a second bore part having an inner diameter which is larger than that of the first bore part, wherein the first opening and the second opening are arranged in the first bore part and displaced along the bore extension, and the annular barrier further comprises:

a piston arranged in the bore and movable between an initial position where fluidic communication between the first and second openings is permitted and a closed position in which fluidic communication between the first and second openings is blocked, the piston comprising a first piston part having an outer diameter corresponding to the inner diameter of the first bore part and comprising a second piston part having an outer diameter corresponding to the inner diameter of the second bore part, wherein the movable piston comprises a fluid channel being a through bore providing fluid communication between the first and second bore parts, and a rupture element preventing movement of the piston until a predetermined pressure in the bore is reached.

2. A downhole annular barrier according to claim 1, further comprising a locking element adapted to mechanically lock the piston when the piston is in the closed position, blocking the first opening.

3. A downhole annular barrier according to claim 2, wherein the locking element is configured to move at least partly radially outwards or inwards upon movement of the piston away from the initial position to prevent the piston from returning to the initial position of the piston.

4. A downhole annular barrier according to claim 2, wherein the locking element is configured to permanently lock the piston in a closed position.

5. A downhole annular barrier according to claim 1, wherein the piston has a centre axis arranged in a wall of a connection part connecting the expandable metal sleeve with the tubular part.

6. A downhole annular barrier according to claim 1, wherein the annular barrier comprises a third opening which is in fluid communication with the annulus.

7. A downhole annular barrier according to claim 1 wherein in the closed position, the second opening is in fluid communication with the third opening in order to equalise the pressure between the annular space and the annulus.

8. A downhole annular barrier according to claim 1, wherein the rupture element is a shear pin engaging the piston.

9. A downhole annular barrier according to claim 1, wherein the rupture element is a shear disc arranged in the fluid channel or the first bore part for preventing flow past the disc.

10. A downhole annular barrier according to claim 1, wherein the piston has a first piston end at the first piston part and a second piston end at the second piston part, the first piston end having a first piston face and the second piston end having a second piston face, the second piston face having a face area which is larger than a face area of the first piston face in order to move the piston towards the first bore end.

11. A downhole annular barrier according to claim 1, wherein the first piston part extends partly into the second bore part in the initial position of the piston and forms an annular space between the piston and an inner wall of the bore.

12. A downhole annular barrier according to claim 1, further comprising a third opening in the second bore part, which third opening is in fluid communication with the annular space and the annulus.

13. A downhole annular barrier according to claim 1, wherein the first piston part comprises two annular sealing elements arranged in an annular groove in the first piston part at a predetermined distance so that the sealing elements are arranged at opposite sides of the first opening in the closed position of the piston.

14. A downhole annular barrier according to claim 2, wherein the second piston part comprises the locking element arranged in the second piston end of the piston, the locking element including springy elements projecting outwards when being released when the piston moves to block the first opening.

15. A downhole annular barrier according to claim 2, wherein the locking element is arranged around the second piston part.

16. A downhole annular barrier according to claim 2, wherein the bore has a third bore part, the second bore part being arranged between the first bore part and the third bore part, the third bore part having an inner diameter which is larger than the inner diameter of the second bore part, and the locking element being arranged in third bore part.

17. A downhole annular barrier according to claim 16, wherein the locking element is a plurality of inserts arranged in the third bore part around the second piston end.

18. A downhole annular barrier according to claim 2, wherein the locking element further comprises at least one spring member arranged in a circumferential groove formed in an outer face of a plurality of inserts, so that the inserts are held together and forced radially inwards when the piston moves to close off for fluid communication to the inside of the tubular part.

19. A downhole annular barrier system comprising a downhole annular barrier according to claim 1 and a pressure source.

20. A downhole annular barrier according to claim 1, wherein the rupture element is positioned in the fluid channel when the piston is in the initial position.

* * * * *